United States Patent [19]

Barkley

[11] 4,265,998

[45] May 5, 1981

[54] ELECTROPHOTOGRAPHIC PHOTORECEPTIVE BACKGROUND AREAS CLEANED BY BACKCHARGE PROCESS

[75] Inventor: John A. Barkley, Boulder, Colo.

[73] Assignee: International Business Machines Corporation, Armonk, N.Y.

[21] Appl. No.: 93,551

[22] Filed: Nov. 13, 1979

[51] Int. Cl.[3] ..... G03G 13/22

[52] U.S. Cl. ..... 430/125; 430/55; 430/126; 430/902; 355/3 CH; 355/15; 250/325; 118/652; 118/653; 430/122; 430/31

[58] Field of Search ..... 430/125, 126, 53, 902; 118/652, 653; 355/15, 3 CH; 250/325

[56] References Cited

U.S. PATENT DOCUMENTS

| | | | |
|---|---|---|---|
| 2,701,764 | 2/1955 | Carlson | 250/315.1 |
| 3,355,289 | 11/1967 | Hall et al. | 430/126 |
| 3,444,369 | 5/1969 | Malinaric | 250/65 |
| 3,456,109 | 7/1969 | Gawron . | |
| 3,598,580 | 8/1971 | Baltazzi | 430/126 |
| 3,628,950 | 12/1971 | Wirley | 430/121 |
| 3,637,306 | 1/1972 | Cooper | 355/15 |
| 3,640,707 | 2/1972 | Caldwell | 430/121 |
| 3,646,866 | 3/1972 | Baltazzi | 430/126 |
| 3,647,293 | 3/1972 | Queener | 355/15 |
| 3,649,262 | 3/1972 | Cade | 355/15 X |
| 3,779,749 | 12/1973 | Sato | 250/49.52 C X |
| 3,784,299 | 1/1974 | Manghiramalani | 355/3 |
| 3,789,222 | 1/1974 | Sato | 250/325 |
| 3,797,927 | 3/1974 | Takahashi et al. | 355/3 |
| 3,797,928 | 3/1974 | Kinoshita | 355/3 |
| 3,843,885 | 10/1974 | Sato et al. | 250/326 |
| 3,901,189 | 8/1975 | Fraser | 118/637 |
| 3,914,045 | 10/1975 | Namiki | 355/15 |
| 3,967,891 | 7/1976 | Rippstein | 355/3 R |
| 3,994,725 | 11/1976 | Volkers | 430/126 |
| 3,997,259 | 12/1976 | Bhagat | 355/3 R |
| 4,038,544 | 7/1977 | Shenoy | 250/315 R |
| 4,063,943 | 12/1977 | Hoene et al. | 430/46 |
| 4,063,945 | 12/1977 | Hoene et al. | 430/55 |
| 4,087,170 | 5/1978 | Sawaoka | 355/3 CH |
| 4,141,648 | 2/1979 | Gaitten | 355/14 |
| 4,167,325 | 9/1979 | Plumadore | 355/14 |

OTHER PUBLICATIONS

IBM TDB, vol. 14, #11 (4/1972), pp. 3325–3326.
IBM TDB, vol. 16, #9 (2/1974), p. 2958.

*Primary Examiner*—John D. Welsh
*Attorney, Agent, or Firm*—Charles E. Rohrer

[57] ABSTRACT

Process for eliminating the need for a separate cleaning station in a one-cycle electrophotographic document copier machine of the transfer type. A backcharge corona generator is added to provide an overcharge/backcharge process to obtain the desired level of charge on the photoconductive system prior to exposure of the photoreceptor to the subject. In that manner, residual toner remaining on the photoconductor after production of the previous copy is cleaned simultaneously with the development of the succeeding copy.

44 Claims, 33 Drawing Figures

POST CHARGE
1st COPY

POST ERASE
1st COPY

POST EXPOSE
1st COPY

POST DEVELOP
1st COPY

POST TRANSFER
1st COPY

POST PRECLEAN
1st COPY

POST CHARGE
2nd COPY

POST ERASE
2nd COPY

POST EXPOSURE
2nd COPY

POST DEVELOPMENT
2nd COPY

POST TRANSFER
2nd COPY

POST TRANSFER
AFTER 5 COPIES

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper work being processed to accomplish the change. The disposition for the paper work should only be considered when making modifications to Engineering Specifications, Reference Drawings, Artwork, Wire Lists, Engineering Instructions, MFI or any part numbe that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 19

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper work being processed to accomplish the change. The disposition for the paper work should only be considered when making modifications to Engineering Specifications, Reference Drawings, Artwork, Wire Lists, Engineering Instructions, MFI or any part numbe that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 20

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper work being processed to accomplish the change. The disposition for the paper work should only be considered when making modifications to Engineering Specifications, Reference Drawings, Artwork, Wire Lists, Engineering Instructions, MFI or any part number that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 21

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper work being processed to accomplish the change. The disposition for the paper work should only be considered when making modifications to Engineering Specifications, Reference Drawings, Artwork, Wire Lists, Engineering Instructions, MFI or any part number that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 22

POST CHARGE
1st COPY

POST BACKCHARGE
1st COPY

POST CHARGE
2nd COPY

POST BACKCHARGE
2nd COPY

DEVELOPMENT

POST DEVELOPMENT
2nd COPY

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper work being processed to accomplish the change. The disposition for the paper work should only be considered when making modifications to Engineering Specifications, Reference Drawings, Artwork, Wire Lists, Engineering Instructions, MFI or any part numbe: that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 29

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper work being processed to accomplish the change. The disposition for the paper work should only be considered when making modifications to Engineering Specifications, Reference Drawings, Artwork, Wire Lists, Engineering Instructions, MFI or any part numbe that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 30

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper-work being processed to accomplish the change. The disposition for the paper work should only be considered when making modifications to Engineering Specifications, Reference Drawings, Artwork, Wire Lists, Engineering Instructions, MFI or any part numbe: that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 31

DEVELOPER TEST MASTER

Section: 2
Subject: 1
Sheet 1 of 3
Date Issued: 9-1
Date Revised:

SUBJECT: Stock Dispositions

PURPOSE: To provide Engineering personnel with a selection of dispositions to apply to all parts and documents being processed in an Engineering Change.

Each part in an Engineering Change must specify a disposition for the physical parts identified by that part number of the existing documents (if no physical parts exist). This disposition is to be placed in the "Disposition Stamp" which must be stamped on the flap of the brownlines. It must apply to all parts in stock and in process and those on order.

When applying a dispostion the originator should consider the change to the physical parts rather than the paper-work being processed to accomplish the change. The disposition for the paper work should only be considered when making modifications to Engineering Specifications, Reference Drawings, Artwork, Wire Lists, Engineering Instructions, MFI or any part numbe: that does not have physical parts. The disposition applying to these documents is generally #18 "Destroy all copies not to this EC level."

Parts being released should specify a disposition of "Release". Pre-numbered disposition should be used whenever possible. By placing numbers, such as "8 & 10", in the "Disposition Stamp" the writing out of a lengthy disposition is eliminated.

If a pre-numbered disposition is not applicable the "Disposition Stamp" may be checked "See Explanation" and a special disposition written out.

ANY DISPOSITION CALLING FOR THE REWORKING OR SCRAPPING OF PARTS MUST SPECIFY THE MAXIMUM REWORK.

FIG. 32

ELECTROPHOTOGRAPHIC PHOTORECEPTIVE BACKGROUND AREAS CLEANED BY BACKCHARGE PROCESS

This invention relates to electrophotography and more particularly to a process in which residual toner particles on background areas of an imaged photoreceptor are cleaned while character areas are developed.

BACKGROUND OF THE INVENTION

In electrophotographic machines, copies of documents or other subjects are produced by creating an image of the subject on a photoreceptive surface, developing the image and then fusing the image to copy material. In some machines, the copy material may itself be specially prepared with a photosensitive coating enabling the image to be placed directly upon the copy material. In machines utilizing plain bond copy paper or other ordinary image receiving material not specially coated, the electrophotographic process is of the transfer type where a photoreceptive material is placed around a rotating drum or arranged as a belt to be driven by a system of rollers. In the typical transfer process, photoreceptive material is passed under a stationary charge generating station to place a relatively uniform electrostatic charge, usually several hundred volts, across the entirety of the photoreceptive surface. Next, the photoreceptor is moved to an imaging station where it receives light rays reflected from the document to be copied. Since white areas of the original document reflect large amounts of light, the photoreceptive material is discharged in white areas to relatively low levels while the dark areas continue to contain high voltage levels even after exposure. In that manner, the photoreceptive material is caused to bear a charge pattern which corresponds to the printing, shading, etc. present on the original document.

After receiving the image, the photoreceptor is moved to a developing station where a developing material called toner is placed on the image. This material may be in the form of a black powder which carries a triboelectric charge opposite in polarity to the charge pattern on the photoreceptor. Because of the attraction of the oppositely charged toner, it adheres to the surface of the photoreceptor in proportions related to the shading of the original. Thus, black character printing should receive heavy toner deposits, white background areas should receive none, and gray or otherwise shaded half tone character portions of the original should receive intermediate amounts.

The developed image is moved from the developer to a transfer station where a copy receiving material, usually paper, is juxtaposed to the developed image on the photoreceptor. A charge is placed on the back side of the copy paper so that when the paper is stripped from the photoreceptor the toner material is held on the paper and removed from the photoreceptor. Unfortunately, the transfer operation seldom transfers 100% of the toner from the photoreceptor to the copy paper. Toner remaining on the photoreceptor after transfer is called "residual toner" and may amount to 15% or more of the toner present on the photoreceptor prior to transfer.

The remaining process steps call for permanently bonding the transferred toner material to the copy paper and cleaning the residual toner left on the photoreceptor so that it can be reused for a subsequent copy production.

In the cleaning step, it is customary to pass the photoreceptor under a preclean charge generating station to neutralize the charged areas on the photoreceptor. The photoreceptor may also be moved under an erase lamp to discharge any remaining charge. In that manner, the residual toner is no longer held by electrostatic attraction to the photoreceptive surface and thus it can be more easily removed at a cleaning station.

In order to avoid overburdening the cleaning station, it is customary to remove all charge present on the photoreceptive surface outside of the image area prior to the development step. This is usually done by using an interimage erase lamp to discharge photoreceptive material between the trailing edge of one image and the leading edge of the next. Also, erase lamps are used to erase charge along the edges of the photoreceptor outside of the image area. For example, if the original document is 8.5×11 inches in size, and if a full sized reproduction is desired, the dimensions of the image on the photoreceptor will also be 8.5×11 inches. The interimage and edge erase lamps remove charge outside of the 8.5×11 inch area.

The copy process above described has been in use for many years in the document copier industry. Machines utilizing this process have been well received by the general public since the quality of the copy produced is superior. However, electrophotographic machines of the transfer type are not without problems; one is that the machines are expensive and a second is that they are complex and have a tendency to break down. One of the major causes of these problems has been the cleaning apparatus used in the process. While many improvements have been made, no one has successfully provided a cleaning station which is completely reliable and, in fact, the cleaning station is usually one of the most troublesome components in commercial machines. Moreover, quality cleaning is difficult; that is, even after the cleaning operation, some residual toner is frequently left upon the photoreceptive surface. This residual toner can show up as high background on copies and also can build up and create a toner film on photoreceptive surfaces which ultimately destroys the value of the surface and necessitates the installation of a new surface. Additionally, since the cleaning station cleans away residual toner, it uses up the charge of toner in the developer thus creating a need for adding toner. Since toner is an expensive supply item, this need to replace toner adds to the cost of operating the machine. Finally, since the cleaning station is accumulating toner, service is periodically necessary simply to remove the toner from the cleaning station. To solve this problem, some machines have attempted to recycle cleaned away toner by sending it back to the developer station. Attempts to recycle toner, while a good idea, have usually brought added reliability problems to the machine to such an extent that recycling apparatus is not in common use.

To solve these problems, it has been reasoned that the best remedy is to simply rid the machine of the need for a cleaning station. To do that, a combined developer/cleaner apparatus was invented so that residual toner could be cleaned from the photoreceptive surface in the developer itself thus eliminating the need for additional troublesome apparatus and avoiding the accumulation of residual toner outside the developer. Cleaner/developer apparatus of this type is the subject of U.S. Pat. No. 3,647,293 which describes a two-cycle process where the development occurs on a first cycle and the cleaning occurs on a second cycle. While this two-cycle process is a suitable solution to the problems of separate cleaning stations, it is apparent that two cycles of the photoreceptor are needed to produce a single copy and therefore the technique is limited to slower speed machines. Considerable effort has been expended in attempting to remove a cleaning station from one-cycle machines so that the advantages of eliminating a cleaning station could be brought to higher speed equipment. For example, U.S. Pat. No. 3,649,262 describes a copier machine with cascade type developer/cleaner apparatus in a one-cycle operation. The patent suggests that there are a great many variables which must be considered to make the machine operate successfully. Included among these variables is the position of the development electrode relative to the vertical in the cascade type developer, the value of the charge voltage, the value of the development electrode voltage, the developer flow rate, the charge density of the original image, toner size, toner concentration, and carrier size. The techniques described in this patent can successfully produce a few copies without a separate cleaning operation; however, the quality of the copies rapidly deteriorate thus making the process more of a laboratory curiosity than one that can be successfully commercialized.

U.S. Pat. Nos. 3,628,950 and 3,640,707, assigned to the assignee of the 3,649,262 patent described above, expressly refer to difficulties in the process of the 3,649,262 patent and attempt to solve them. The process of the 3,628,950 patent appears essentially identical to the 3,649,262 patent but does contain some discussion of an additional variable, the preclean corona current level. The 3,640,707 patent supplies an extra electrode to the cascade developer in an attempt to aid in the removal of residual toner. Neither of these improvement attempts produced the techniques and solutions of the instant invention and neither have resulted in the production of a commercially successful one-cycle machine without a cleaning station.

U.S. Pat. Nos. 3,598,580 and 3,646,866 disclose a copier machine where a magnetic brush cleaner/-developer apparatus is used in a one-cycle operation. These patents state that when organic photoconductors are used, there is an ability to transfer most of the powder image to the copy paper and thereby obviate the need for cleaning. Again, however, the quality of an image according to the process of these patents rapidly deteriorates as successive copies are produced as shown in FIGS. 19–22 herein where an organic photoconductor was used.

All of the above work was performed several years ago but the problem still remains; how can troublesome cleaning stations be removed from electrophotographic machines without using a two-cycle process.

SUMMARY OF THE INVENTION

This invention solves the above-stated problem. It is an electrophotographic copy process wherein photoreceptive material is charged through bombardment by ions of a first polarity to a level somewhat higher than ultimately desired. The photoreceptive material is then backcharged through bombardment by ions of an opposite polarity in order to reduce the charge to the desired level. The photoreceptor is then exposed, developed and the image transferred to copy paper by customary techniques. After transfer, the photoreceptive material is moved back to the charge station for repetition of the process. No separate cleaning station is used. Residual toner from the preceding copy is cleaned from the photoreceptor simultaneously with the development of the image for the subsequent copy. In its essence, this invention involves cleaning the background white areas of the image while developing the dark character areas of the image throughout the production of successive copies through use of an overcharge/backcharge technique. In some environments, when the subject is changed, separate clean only cycles are run while the change in subject is in process in order to prepare the photoreceptor for receiving a completely different image. In other environments, it may be possible to reproduce different subjects without separate clean only cycles.

In a preferred embodiment, the photoreceptive surface is charged by a negative corona generator to a level of approximately −1200 volts and that charge is reduced to a level of about −850 volts by a positive corona at a backcharging station. By utilizing this overcharging/backcharging technique, it was found that the separate cleaning cycle in the two-cycle process of a successful electrophotographic machine could be eliminated and a copy thereby produced on every cycle of the machine. That is to say, the two-cycle machine was turned into a one-cycle machine thereby allowing machine throughput to be doubled.

Equally astounding results were found through the incorporation of the overcharge/backcharge technique on a successful one-cycle machine. Here, the output was not increased since it was already a one-cycle machine, but it was found that the cleaning station could be completely removed from the machine and successive copies in great number produced without experiencing quality degradation. If anything, quality was improved as the run progressed. Thus, this invention successfully eliminates one of the most costly and troublesome pieces of equipment in the copier machine.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

FIGS. 19–22 show reproductions of copies produced without the instant invention and without a cleaning station separate from the developer.

FIGS. 29 and 32 are reproductions of copies produced with the instant invention.

DETAILED DESCRIPTION

A. The Two Cycle Process

Figure 1:
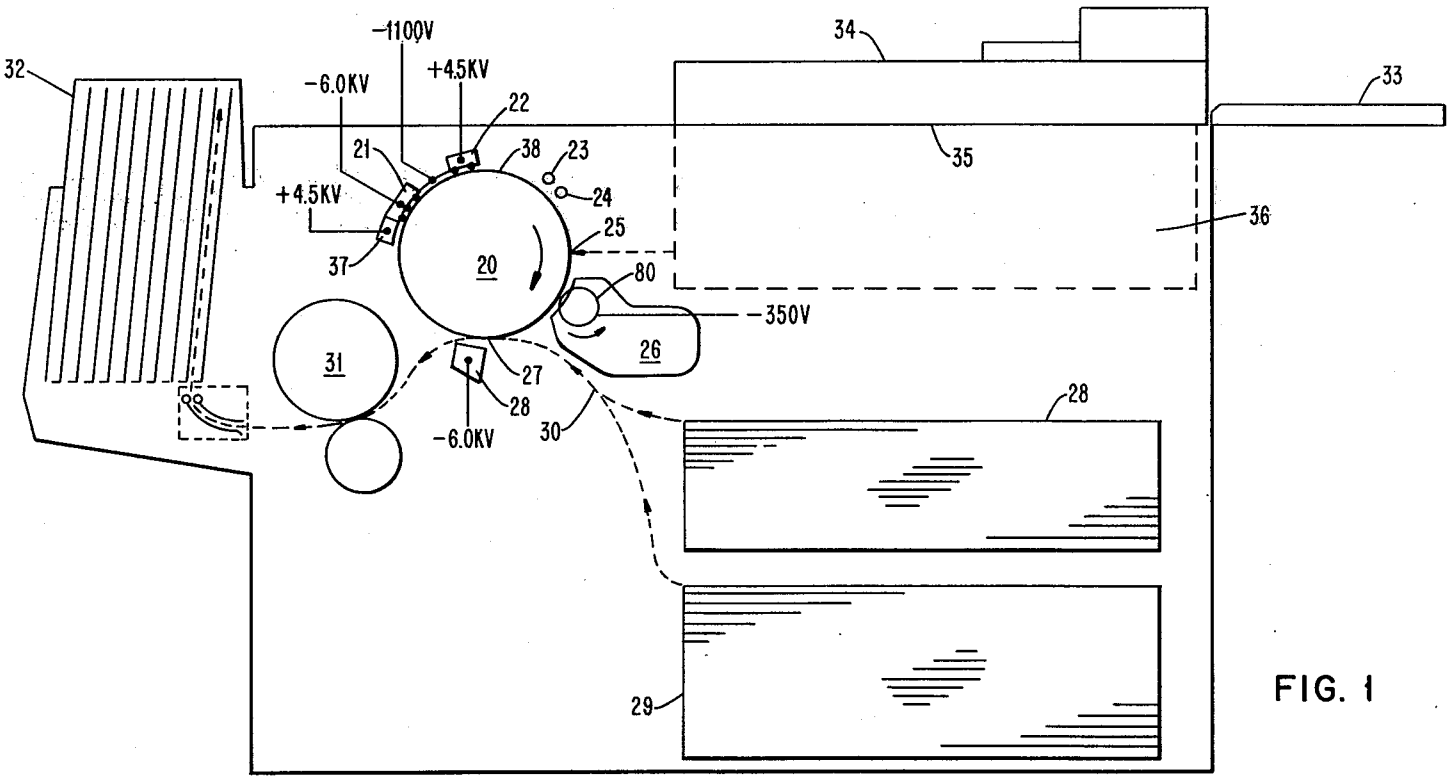
FIG. 1 is a machine with a rotating drum equipped to carry out the process of the instant invention.

FIG. 1 illustrates the paper path of an electrophotographic machine of the transfer type. The particular machine illustrated was a two-cycle machine prior to installation of the backcharge process of the current invention. In the two-cycle method of operation, on the first cycle, photoreceptive surface 38 located on the periphery of drum 20 rotates under the charging corona 21 which places a uniform charge over the entire surface of the photoreceptive material. Note that the emission wire of charge corona 21 is connected to a negative power supply. In other systems utilizing a different kind of photoconductive layer it might be desirable to connect the emission wire to a positive current source. In any case, the photoreceptive material on drum 20 rotates from the charging corona 21 past the backcharge corona 22. In the two-cycle operation prior to the instant invention, the backcharge corona 22 was not present in the machine and therefore, for purposes of illustration at this point, we will consider the backcharge corona 22 not present.

Next, the photoreceptive material 38 is moved under erase lamps 23 and 24 which are energized on the first cycle to discharge the areas of the photoreceptive material which will not receive an image of document to be copied. Consequently, interimage erase lamp 23 is energized between the leading and trailing edge of the image area while edge erase lamp 24 is energized to erase along the edges of the image area. By use of these lamps, charge placed on the photoreceptor by the charging station 21, will continue to exist only in, for example, an 8.5×11″ area of the photoreceptor. That charged area then rotates to the exposure station 25 at which an image of the document to be copied is placed on the charged portion of the photoreceptor. Next, the photoreceptor 38 is moved to the developing mechanism 26 at which toner is placed on the image through rotation of magnetic brush roll 80, then to the transfer station 27 at which the image is transferred to copy paper under the influence of transfer corona 28. Note that the emission wire of transfer corona 28 is also connected to a negative source. Generally, the transfer corona 28 will be connected to a power supply carrying the same polarity as that of the charging corona 21.

The image receiving material, usually copy paper, is moved from one of the copy paper bins 28 or 29 along the illustrated path 30 to the transfer station 27 so that the leading edge of the copy paper mates with the leading edge of the image area. In that manner, the entire image produced on the image area can be transferred to the copy paper. After transfer, the copy paper continues along path 30 through a fusing station 31 at which the toner is permanently impressed onto the surface of the copy paper. After fusing, the copy paper is moved to a final receiving station such as collator 32.

In order to produce an image of a subject such as a document, the document can be inserted manually onto glass exposure platen 35, or inserted onto a semiautomatic document feed tray 33 or fed by an automatic document feed 34 onto platen 35. A scanning optical system 36 is energized at the proper time in the sequence of operation to cause a flowing image of the document on glass platen 35 to be transmitted to the photoconductive material moving past exposure station 25. The speed at which the document on glass platen 35 is scanned by optical system 36 is coordinated with the speed at which drum 20 rotates. In that manner, an image of the original document is produced on photoreceptor 38.

Returning now to the sequence of those operations which occur to the photoreceptive material after transfer, the photoreceptive material is moved to a preclean corona 37 where the negative charge on the image area is neutralized by bombarding the photoreceptor with positive ions. The desired voltage level of the photoreceptor after the preclean step is zero volts, or slightly negative.

During the second cycle of operation, the charge corona 21 is de-energized so that a neutralized photoreceptor with essentially a charge content of zero volts is moved past the de-energized corona 21 past the corona 22, which as noted above, is not needed for illustrating a two-cycle operation, to interimage erase lamps 23 and 24 which are now energized continually to flood the surface of the photoreceptive material to discharge any remaining charge which might still be present. The photoreceptor moves past exposure station 25 which is not used for imaging on the second cycle to the developer/cleaner 26 which is now used to clean residual toner from the surface of the photoreceptor. Residual toner is that toner which was not successfully transferred to the image receiving material at transfer station 27 during the first cycle of the operation. After cleaning the photoreceptive surface, the photoreceptor moves past a de-energized transfer corona 28 and past a de-energized preclean corona 37 to a now energized charging corona 21 at which the two-cycle operation commences a second time for the production of another copy.

B. The Overcharge/Backcharge Process

To change this machine into one that could produce a copy on each and every cycle of drum rotation, the inventor herein added corona 22 and connected it to a positive voltage source. Parameters connected with the charge corona 21 were changed so that instead of the charge corona 21 depositing a uniform charge of approximately −850 volts on the photoreceptive surface 38, corona 21 was made to deposit a charge of about −1200 volts. The positive backcharge corona 22 was then used to reduce the level of the negative charge from −1200 down to −850 volts. The result of adding the overcharge/backcharge technique to the machine illustrated in FIG. 1, was to cause residual toner left on the photoreceptive surface to be cleaned at cleaner/developer 26 simultaneously with the development of an image. The steps of the process are outlined below.

In the one-cycle process of the machine for FIG. 1, after the photoreceptor 38 is charged by corona 21 and backcharged by corona 22, it is moved under erase lamps 23 and 24 to discharge the areas of the photoreceptor that will not receive an image of the document to be copied. The photoreceptor is then moved to exposure station 25 where a flowing image of the original document is placed upon the image area of the photoreceptor. The photoreceptor is then moved to developer/cleaner 26 where the image is developed by depositing toner material onto the surface of the photoreceptor while, at the same time, cleaning away residual toner from the previous cycle. The photoreceptor is then moved to transfer station 27 where the image is transferred to image receiving material as previously described. The photoreceptor continues to move until it reaches preclean corona 37 where the charge on the image area is neutralized to approximately zero volts prior to moving under charge corona 21 for the beginning of the next cycle. Thus, through the addition of backcharge corona 22 and the use of the overcharge/-backcharge technique, the machine of FIG. 1 was converted from a two-cycle machine to a one-cycle machine and was run for up to 50 copies without showing any degradation in the quality of the copy. If anything, the quality of the copy was improved as the 50th copy approached. The limitation of 50 copies was due solely to the incorporation into the machine illustrated in FIG. 1 of a quality control cycle during which various parameters within the image area are checked thus creating a cycle upon which a copy cannot be reproduced. In the particular machine of FIG. 1, that quality control cycle occurs once every 50 copies during a multiple copy run.

After the quality control cycle, or when changing documents to be copied, clean cycles are run to remove residual toner from the dark areas and thus prepare photoreceptive surface 38 for a new subject. In the clean cycle, the charge corona is turned off while the transfer and preclean coronas are energized together with the erase lamps. A gridded backcharge corona need not be turned off on the clean cycle since the grid prevents the corona from affecting the low, approximately zero voltage remaining on the photoconductor after it has passed under the transfer and preclean coronas. Magnetic brush bias voltages can be adjusted if desired.

Figure 2:
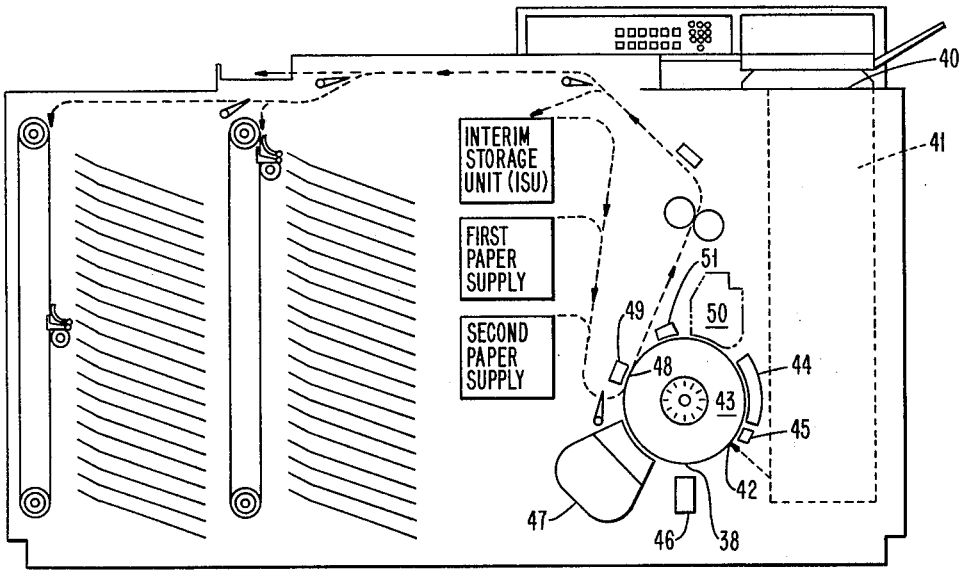
FIG. 2 is a second machine with a rotating drum equipped to carry out the process of the instant invention.

FIG. 2 shows another copier, in this case the IBM Series III copier which has been modified to incorporate the instant invention through the inclusion of backcharge corona 45, removal of cleaning station 50, and the incorporation of the overcharge/backcharge technique. In this machine, an original document is placed on the document glass 40 and is imaged by means of optics shown generally at 41 to create a flowing image at exposure station 42 on the photoreceptive surface 38 of drum 43. The photoreceptive material is charged by corona 44 to a level beyond that desired. The charge is then reduced to the desired level by backcharge corona 45 of opposite polarity to corona 44. After receiving the image of the original document at exposure station 42, the photoreceptive material encounters erase lamps 46 which erase all of the charged area outside of the image area. Next, the photoreceptive material moves under the developer 47 where toner is placed upon the charged image. Next, the image is transferred to image receiving material at transfer station 48 under the influence of transfer corona 49. The photoreceptive material continues to rotate past the cleaning station 50 which is shown in phantom in FIG. 2 to show that it was removed from the machine. A preclean corona 51 remains in operation.

When the backcharge corona 45 was installed in the IBM Series III machine shown in FIG. 2 and the overcharge/backcharge technique practiced together with the removal of the cleaning station 50, the machine was run through the maximum count that the Series III control system handles; that is, 999 copies. It was found that the copies produced near the end of the run were equally as good as those produced at the beginning of the run. If anything, the later copies were superior to those produced near the beginning of the run.

Figure 3:
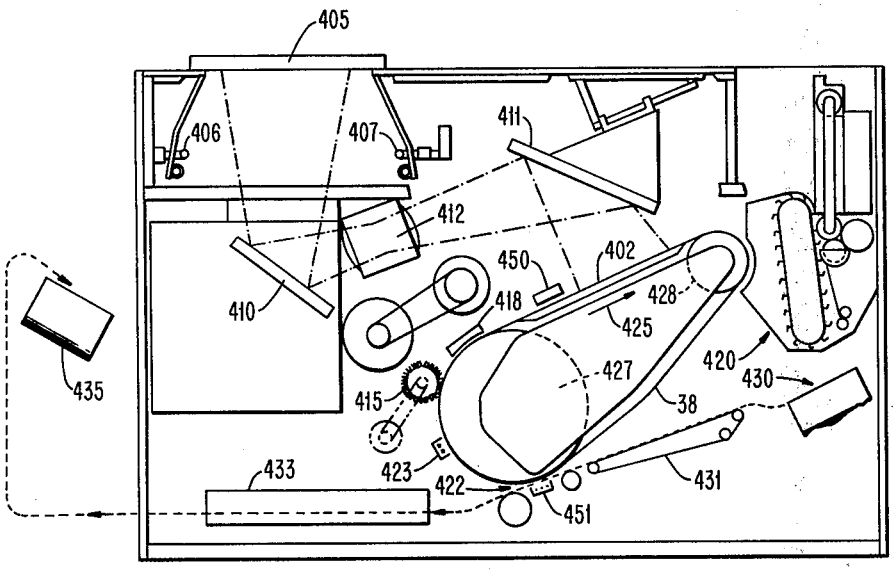
FIG. 3 is a machine with a moving belt equipped to carry out the process of the instant invention.

FIG. 3 shows still another machine in which the backcharge corona of the instant invention can be installed and the cleaning station removed. In this case, exposure of the original document occurs through flash optics and a flat photoreceptive belt is used to receive the image. Otherwise, the process steps of the machine shown in FIG. 3 are similar to those already described for the machines shown in FIGS. 1 and 2. In this machine, the photoreceptive material 38 is charged by charge corona 418 and backcharged with the addition of the backcharge corona 450. The image is placed upon the photoreceptor at 402 and developed through the operation of cascade developer 420. The developed image is transferred to image receiving material at transfer station 422 under the influence of transfer corona 451. The photoreceptive material is then fed past a preclean corona 423 and from there past the now inoperative cleaning station 415, shown in phantom, to the charge corona 418 where the next cycle is begun.

In flash form imaging, an original document is placed on the document glass 405 and at the appropriate point in the sequential operation of the machine, flash bulbs 406 and 407 are energized in order to create light rays carrying the image of the original document to mirror 410 through lens 412 to mirror 411 and from there to the exposure station 402.

Image receiving material is fed from bin 430 across conveyor 431 through the transfer station 422 to fuser 433 and from the fuser to the receiving bin 435.

In addition to the machines illustrated in FIGS. 1, 2 and 3, the instant invention can be applied to moving document copier machines, and to any other suitable electrophotographic copier machine of the transfer type.

C. Theory

The theory of the invention is not yet fully understood. The current thinking as to why this process works successfully will be explained below with reference to the machine shown in FIG. 1 which, prior to installation of the instant invention was a two-cycle machine. In the explanation below, that machine is operated as a one-cycle machine without the instant invention thus providing an explanation of why copy becomes more and more seriously degraded as the process continues. An explanation will then be given showing the salutory effect of the overcharge/backcharge technique. The explanation is identical for the machines shown in FIGS. 2 and 3 and should be considered as applying to them.

Figure 4:
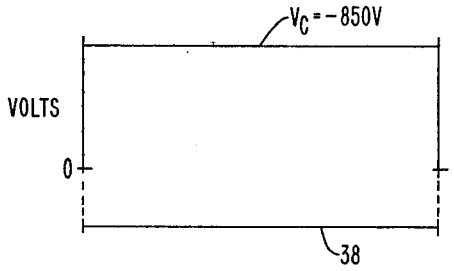
FIGS. 4–18 are diagrammatic illustrations to aid in the explanation of the theory of the invention.
Figure 5:
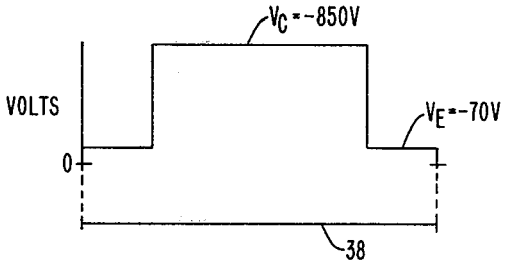
Figure 6:
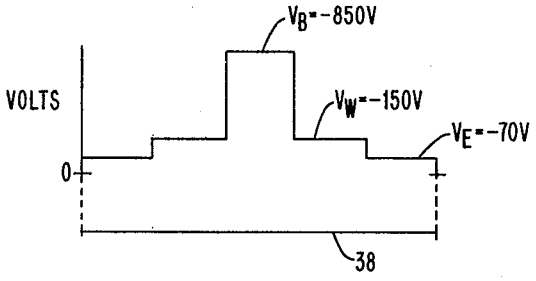

FIG. 4 is a representation of the photoreceptive material 38 laid out in a flat position together with a graphical representation of the charge level present on the photoreceptor immediately after leaving the charge corona 21. FIG. 4 shows that charge corona 21 has charged photoreceptor 38 to a uniform level, $V_C$, equal to $-850$ volts. FIG. 5 illustrates the charge condition of photoreceptive material 38 after it has passed the erase lamps 23 and 24. Here, the level at the image area remains at $-850$ volts while the voltage level, $V_E$, of the areas erased by the erase lamps has been reduced to approximately $-70$ volts. FIG. 6 is a representation of the charge condition of photoreceptive material 38 immediately after it has passed through the exposure station 25. Here the areas that have been erased remain at $-70$ volts. In the image area, however, those parts of the original document which were white have reflected a great amount of light onto the photoreceptive material and discharged that material down to a level, $V_W$, of approximately $-150$ volts. Meanwhile, the black areas, $V_B$, of the original document have reflected very little light and therefore, those areas will ideally remain at about −850 volts. Actually there may be some charge reduction in the black area, but for purposes of this discussion, we shall consider the black voltage as remaining at −850 volts. Gray areas of the document would discharge the photoconductor to voltages between −150 and −850 but for purposes of this illustration such voltages are not shown in FIG. 6.

Figure 7:
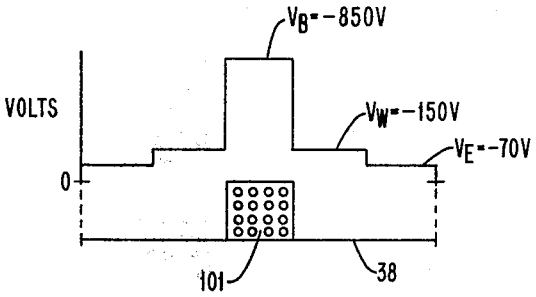

In FIG. 7, the photoreceptive material 38 has just passed the developer station. The developer station does not affect the charge levels present on the photoconductor in any material fashion; that is, the erase voltage remains at −70 volts, the white voltage remains at −150 volts and the black voltage remains at −850 volts. The purpose of the developer station is to place toner material on the image and develop that image out. Consequently, FIG. 7 illustrates toner particles 101 deposited on the photoreceptive material 38 in that area of the image in which there is a black voltage present. Were gray voltages illustrated, smaller amounts of toner would be deposited on those areas of the photoconductor in proportion to the gray voltage level present.

Figure 8:
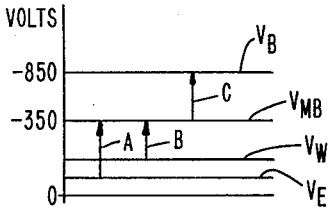

FIG. 8 illustrates the vectors that cause toner to be placed on the photoreceptive material 38 by a magnetic brush developer. Before explaining FIG. 8, however, some discussion of the manner in which a magnetic brush developer operates may be helpful. Briefly, a magnetic brush developer typically comprises a hollow nonmagnetic roll made of conductive material connected to a voltage source. Stationary magnets are positioned inside the hollow roll to attract steel carrier beads to the rotating surface of the roll. The carrier beads are coated with a material such as tetrafluoroethylene to carry a triboelectric charge which may, for example, be negative. As a result, toner particles carrying a positive triboelectric charge are attracted to the carrier and when the carrier is magnetically attracted to the rotating magnetic brush both carrier and toner are moved by the rotating brush roll from a reservoir area to the development zone. In the development zone, referring to FIG. 1, the carrier beads are jammed together between the rotating magnetic brush roll 80 and the more slowly rotating drum 20. As a result, toner particles are mechanically jarred loose from the carrier beads. Additionally, the brush roll 80 may rotate at a peripheral velocity of some three to four times that of the drum 20. With strong development magnets at the development zone, the result is to pull the carrier beads through the narrow development zone causing a brushing effect of the dislodged toner on the drum 20. Since the toner carries a positive triboelectric charge, the dislodged particles are attracted to the highly negative dark areas of the photoreceptive material as they are brushed against it. In that manner, toner is deposited upon the photoreceptive material and develops out the image thereon. Since the erased areas of the photoconductor carry a negative charge of approximately −70 volts and the white areas carry a negative charge of about −150 volts, it is necessary to provide a system which will prevent toner from being deposited on those areas of the photoreceptive surface 38. Consequently, a negative voltage which may be, for example, −350 volts, is placed on the conductive rotating magnetic brush shell. FIG. 8 is a vector diagram showing the results of such an arrangement. Since the erase voltage is approximately −70 volts, a vector A of −280 volts is created in the erased areas. Vector A acts to attract the positive toner away from the erased areas of the photoreceptive material and back to the surface of the rotating magnetic brush. Vector B, also shown in FIG. 8, is equal to the differential between the white voltage level and the magnetic brush voltage level, in this case, equal to −200 volts. As a consequence, toner is attracted from the white voltage areas of the photoreceptive material toward the rotating surface of the magnetic brush. In that manner, toner is not deposited on the white portions of the image area. However, since the black voltage level is more negative than the magnetic brush voltage, the vector C is created, in this case equal to 500 V, which draws toner away from the magnetic brush and to the black areas of the photoreceptive surface. In that manner, the developer 26 of FIG. 1 deposits toner on the black areas diagrammatically illustrated at 101 in FIG. 7.

Figure 9:
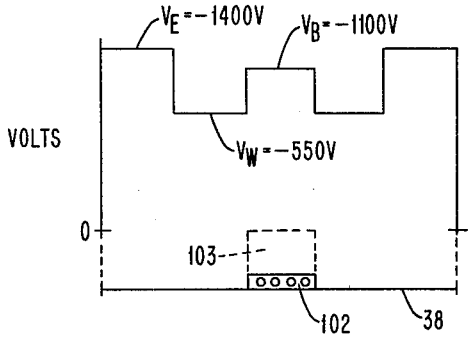

FIG. 9 shows the photoreceptive material 38 just after it has passed the transfer station 27 and shows a change in white voltage level to about −550 volts and a change in black voltage to about −1100 volts. These changes occur because of negative charge passing through the image receiving material at the transfer station and the level is dependent upon the conductivity of the material. The areas outside the image area receive a negative charge at transfer and are shown as reaching −1400 volts. The purpose of the transfer corona is to cause a deposit of negative charge on the back side of image receiving material to attract the positive toner from the surface of the photoconductor to the material. That is illustrated in FIG. 9 in that the toner material 103 is shown in phantom as having been removed from the photoreceptive material 38. There is, however, some residual toner 102 which remains on the surface of the photoreceptive material. Additionally, the negative charge that bleeds through the image receiving material during the transfer process will cause some residual toner 102 to take a negative charge. Most of it will probably still be positive.

Figure 10:
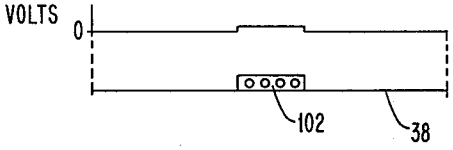

FIG. 10 shows the condition of photoreceptive material 38 immediately after passing under the preclean corona 37. The effect of the corona is to neutralize the negative charge on the photoreceptive surface 38 producing approximately zero volts on that surface. There may, however, remain some small negative charge under the areas which carry residual toner since the positive ions from the preclean corona will be deposited on the toner and therefore may not reach the photoreceptive surface. In any event, any residual toner which was made negative at the transfer station will in all likelihood once again be made positive by passing under the preclean corona.

Figure 11:
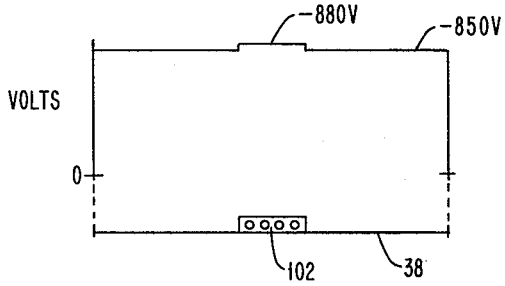

FIG. 11 illustrates the condition of photoreceptive material 38 after it passes a second time under the charge corona 21. Once again, the voltage level on the photoconductor 38 has been increased to a level of −850 volts. There may be some minor variation in voltage in the area of the residual toner 102 but essentially the charge on the photoconductor is uniform. In FIG. 11, this voltage variation is 30 volts, raising the charge level to −880 volts.

Importantly, the residual toner is now being bombarded by negative ions and is turned almost completely negative after passing under the charge corona.

Figure 12:
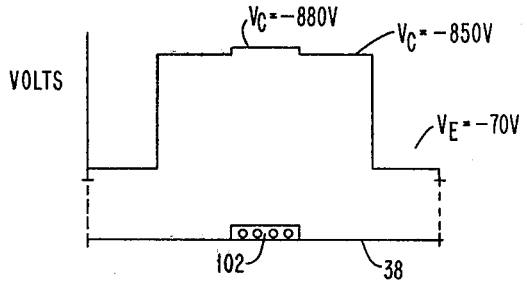

FIG. 12 shows the condition of photoreceptive material 38 after it is passed under the erase station for the second copy. Here the only material effect is to reduce the charge level outside the image area of the photoconductor to approximately −70 volts.

Figure 13:
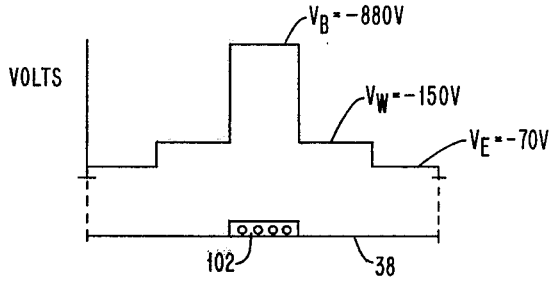

FIG. 13 shows the charge condition of the photoreceptive material 38 after it has passed the exposure station on the second cycle. Here the reflected light from the white areas of the original document have produced a white voltage level of −150 volts while the black voltage level remains at approximately −880 volts and the erased voltage level at approximately −70 volts.

Figure 14:
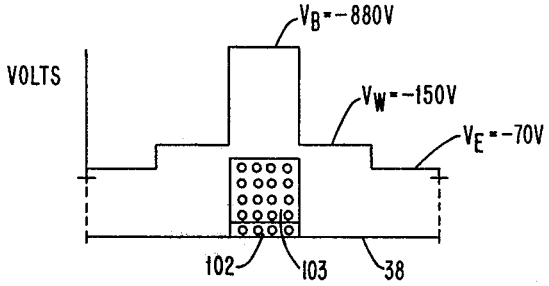

FIG. 14 shows the condition of photoreceptive material 38 after it has passed the development station. Here the voltage level remains unchanged on the photoreceptor while a new deposit of toner has been received on the area of the photoreceptor containing the black voltage. That toner is shown as 103 in FIG. 14.

Figure 15:
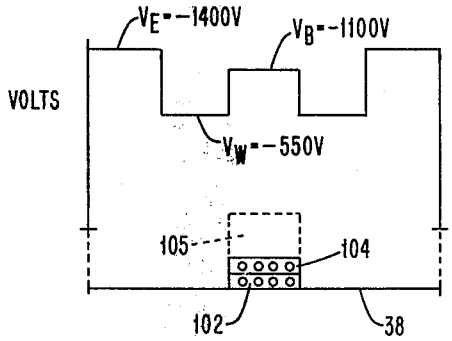
Figure 16:
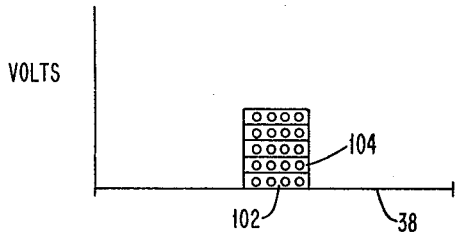

FIG. 15 illustrates the condition of photoreceptive material 38 after it has passed the transfer station 27 on cycle two. Note that a large portion 105 of the toner has been removed from surface 38 and deposited on the image receiving material. However, a new layer of residual toner 104 is left on the surface of photoreceptive material 38, adding to the previous layer 102. Remember that the toner carries a positive charge. And remember that the residual toner 102 had had that positive charge changed to a negative charge when it had passed under the charge corona on the beginning of the second cycle. Consequently, the positive toner 104 strongly adheres to the negative toner 102 helping to create the second layer 104 of built up residual toner as shown in FIG. 15. If successive copies are made, additional layers of residual toner will be built up as shown in FIG. 16 since on each successive copy the residual toner will be passed under the highly negative charge corona and thereby converted to a negative charge. As a consequence, the negative residual toner will not be transferred to the negative copy paper at the transfer station and will not be attracted to the negative magnetic brush development roll at the developer/cleaner 26.

Figure 17:
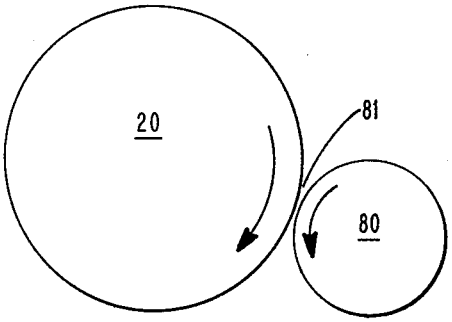
Figure 18:
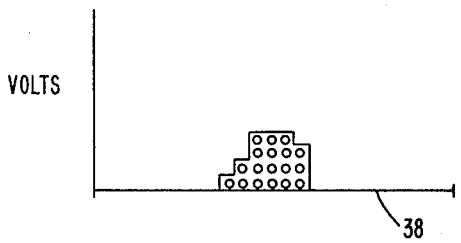

FIG. 17 is an illustration of the photoconductive drum 20 and the magnetic brush roll 80. The development zone 81 is the interface area between the roll and the drum. It has been found that in order to deliver sufficient toner to get good development, it is necessary to rotate the small magnetic brush roll 80 at approximately three times the velocity of the drum 20. As a consequence, a shearing force is produced in zone 81 and acts upon the built up residual toner illustrated in FIG. 16. Because of this shearing force, some of the residual toner is moved away from the area upon which it previously rested so that it takes a configuration somewhat similar to that shown in FIG. 18. As a consequence of the smearing of residual toner, largely negative, on areas of the photoconductor which are ordinarily white areas, when the developer station is reached again, positive toner is deposited on the smeared negative residual toner and is then transferred to copy material. This causes toner to appear in white areas near black areas resulting in a smearing effect of the black characters on the copy material. As additional copies are made, layers of residual toner are spread further and further away from the original black areas thus causing increased degradation of copy quality as successive copies are produced.

It should be noted that were a more efficient developer devised, that is, one which did not create the shearing forces described with reference to FIG. 17, it is expected that there would still be a migration of residual toner into the white areas of the machine because of fringe fields between the highly negative residual toner and the much less negative discharged areas of the exposed white voltage areas. These fringe fields would tend to entrap positive toner particles at the developer station. These positive particles would pile up along side the highly negative residual toner thus extending transferable toner into the white voltage areas.

Thus we have described a theory as to why one cannot simply run a two-cycle machine as a one-cycle machine without a cleaning station and expect to produce quality copy through successive operations of the machine. For example, FIG. 19 is a reproduction of the first copy produced on the machine shown in FIG. 1. Inspection of FIG. 19 shows that a quality reproduction has been produced. FIG. 20 shows the tenth copy produced on the machine of FIG. 1 according to the process just described. Note that toner has migrated out from the black areas of the copy resulting in a smearing which was not present on the first copy. FIG. 21 is the twenty-fifth copy produced in the operation and graphically demonstrates a very serious toner migration problem. FIG. 22 is the fiftieth copy produced on the machine and shows that smearing continues to advance away from the black areas.

Figure 23:
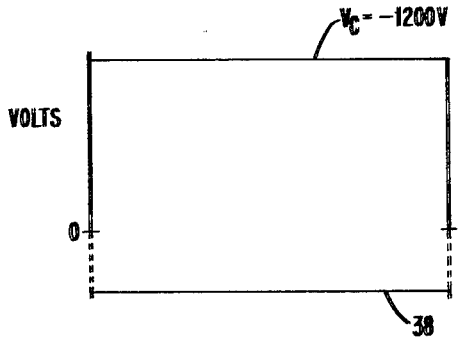
FIGS. 23–28 are more diagrammatic illustrations in relation to invention theory.
Figure 24:
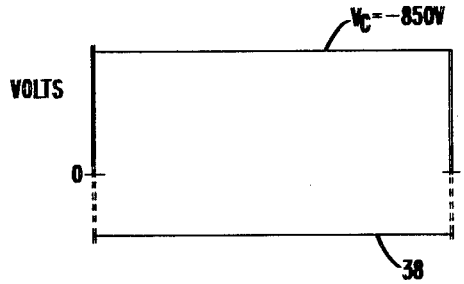

Suppose, however, that the machine shown in FIG. 1 is modified according to the teaching of the instant invention; that is, a positive backcharge corona 22 is put into place and the overcharge/backcharge process is used. FIG. 23 illustrates the photoreceptor 38 just after passing through the charge station. Here a value of −1200 volts has been placed on the photoreceptor as a result of bombardment of it by negative ions produced by the corona 21. FIG. 24 illustrates the condition of the photoreceptor 38 just after it is passed through the backcharge corona 22. Now the photoreceptor 38 has been bombarded with positive ions to such an extent as to reduce the voltage level on the photoreceptor to −850 volts. Now the photoreceptor is in exactly the same condition as was the photoreceptor after it had passed through the charge corona in the previous explanation as shown in FIG. 4. Consequently, the remaining parts of the process will remain exactly as they were in the previous explanation in FIGS. 5 through 10.

Figure 25:
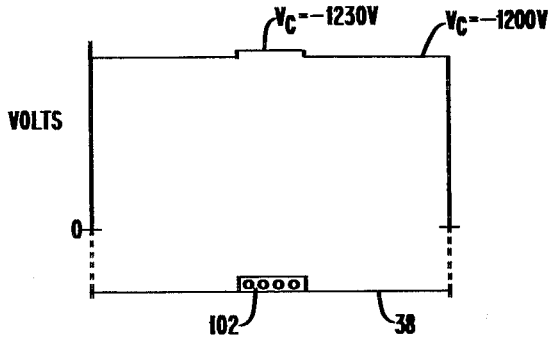
Figure 26:
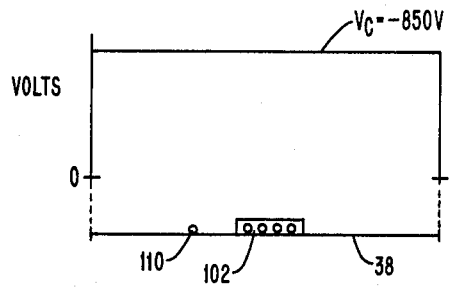
Figure 27:
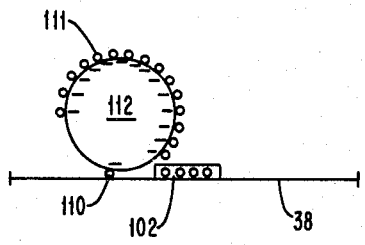

FIG. 25 illustrates the condition of photoreceptor 38 after it is passed through the charge corona during a second rotation. The charge condition is at −1200 volts and the residual toner 102 has been turned mostly negative. However, as shown in FIG. 26, now the photoreceptor 38 passes under a positive backcharge corona with the result that the charge level is reduced to −850 volts on the surface of the photoreceptor 38 and with the significant result that the residual toner 102 has been bombarded by positive ions thus changing the polarity of the residual toner back to its native positive condition. FIG. 26 also illustrates a toner particle 110 which has been knocked away from the black area into the white area of the photoconductor. As a result of bombardment by positive ions at the backcharge corona, toner particle 110 is also now positive. FIG. 27 is an illustration of the action which takes place on the surface of the photoreceptor 100 at the developer station during the development of the second copy. Here a carrier bead 112 with its native triboelectric negative charge is shown carrying many positive toner particles 111. In the development zone, carrier beads are jammed together as they are forced into a narrow passageway between magnetic brush development roll 80 and the surface of the photoreceptor carried on drum 20. As a result, particles such as stray toner particles 110 may be jarred loose from the surface of the photoreceptor. Also, these stray particles may be dislodged by being subjected to the brushing action of the fast moving carrier. Since the dislodged stray toner particles carry a positive charge, they are attracted to the negative triboelectric charge of carrier bead 112 and consequently carried away from the photoreceptive surface. Had the stray toner particles 110 remained negative as they would have without backcharge corona 22, they would not have been attracted to the carrier bead 112 and would probably have remained on the surface of the photoreceptor. In this manner, therefore, residual toner which is present in the white area of a photoreceptor is cleaned away from that white area thus retaining quality background during the production of successive copies.

Figure 28:
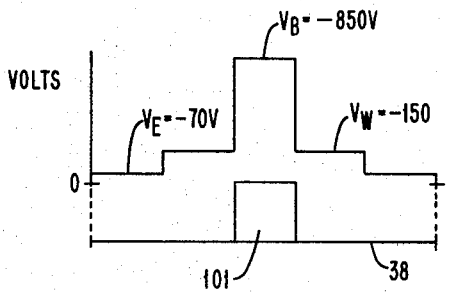

Meanwhile, residual toner 102 in the black area of the photoconductor has also been converted to a substantially positive condition by backcharge corona 22. As a result, when additional toner is deposited on the black areas in accordance with the high negative charge resident on the photoreceptor in that area, the layer 102 is substantially positive just the same as the newly deposited toner. As a result, at the transfer station there is no new layer of residual toner created. This is illustrated in FIG. 28 where an entirely positive layer of toner 101 is shown deposited on photoreceptor 38. Thus, the condition of the photoreceptor post development on the second copy has been returned to the same condition that it had after development on the first copy. As a consequence, when the developed image is transferred to the copy paper, the second copy will look the same as the first copy and the tenth copy will look the same as the first copy and the twenty-fifth copy will look the same as the first copy and so on.

It should be noted that testing has not been performed to determine whether layer 102 is entirely positive after experiencing the bombardment of ions from the backcharge corona. Even if some negative particles remain, the accumulation of untransferred residual toner is greatly retarded and any toner from this untransferred residual which is sheared away from the black areas is returned to its native positive charge by bombardment of positive ions at the backcharge corona and is therefore prevented from creating the smearing effect which occurs without the backcharge process.

To illustrate this, FIG. 29 is the first copy produced on the machine of FIG. 1. FIG. 30 is the fiftieth copy produced on that machine. As may be observed, the fiftieth copy shows no smearing into the background areas around the dark character areas. Thus, through the utilization of the inventive technique, a two-cycle machine has been made to produce copies on every cycle; that is, it has been turned into a onecycle machine and quality copies have been obtained from the beginning to the end on a multi-copy run.

The machine illustrated in FIG. 1, with the addition of the backcharge corona 22, can not only be operated as a one-cycle machine, it can also still be operated as a two-cycle machine if desired. To illustrate a need for such an operation, suppose that the peripheral surface of drum 20 was approximately 15 inches and it was desired to produce 14 inch long copies. In such a case, the entire peripheral area of the drum 20 will be occupied by the image area except for one inch between the trailing and leading edge. As a consequence, when an optical scanning mechanism 36 is used, there is only one inch of movement of the photoreceptor to move from a final position back to a start position during a rescan operation. Since that is probably not enough time in which to perform the rescan, a second copy could not be produced on the second cycle of rotation of drum 20. In this case, the second cycle would be a normal clean cycle as practiced in the ordinary two-cycle operation.

However, when an 11 inch document is to be copied onto the surface of the photoreceptor, assuming once again that the peripheral distance around the surface of the drum is 15 inches, there are now 4 inches available between the leading and trailing edge of the image area. It has been found possible in a scanning machine such as illustrated in FIG. 1 to rescan the optics 36 within that time period and thus the machine can produce a copy on every cycle of machine operation. A scanning/rescanning optical drive which can perform in the manner just described is fully disclosed in U.S. Appl. Ser. No. 100773, filed Dec. 6, 1979. It should also be noted that the practice of this invention in some environments may require close control over the coordination of the movement of optical scanning mechanisms and drum speed so that successive images of the same document are registered upon one another without material variation. The optical drive system described in the above-named patent application also meets that requirement.

Some experimentation has proceeded on the machine shown in FIG. 2, the IBM Series III machine. In this machine, cleaning station 50 was removed and backcharge corona 45 was installed. FIG. 31 shows the first copy produced during a run on the machine and FIG. 32 shows the 999th copy produced on the same run. A comparison of the two figures shows quality on the last copy equal to the first even though the cleaning station was gone. To those skilled in the art, this result is astounding. Note that even the blemishes present on the copies from an improperly operating machine do not worsen as the run progresses.

Figure 33:
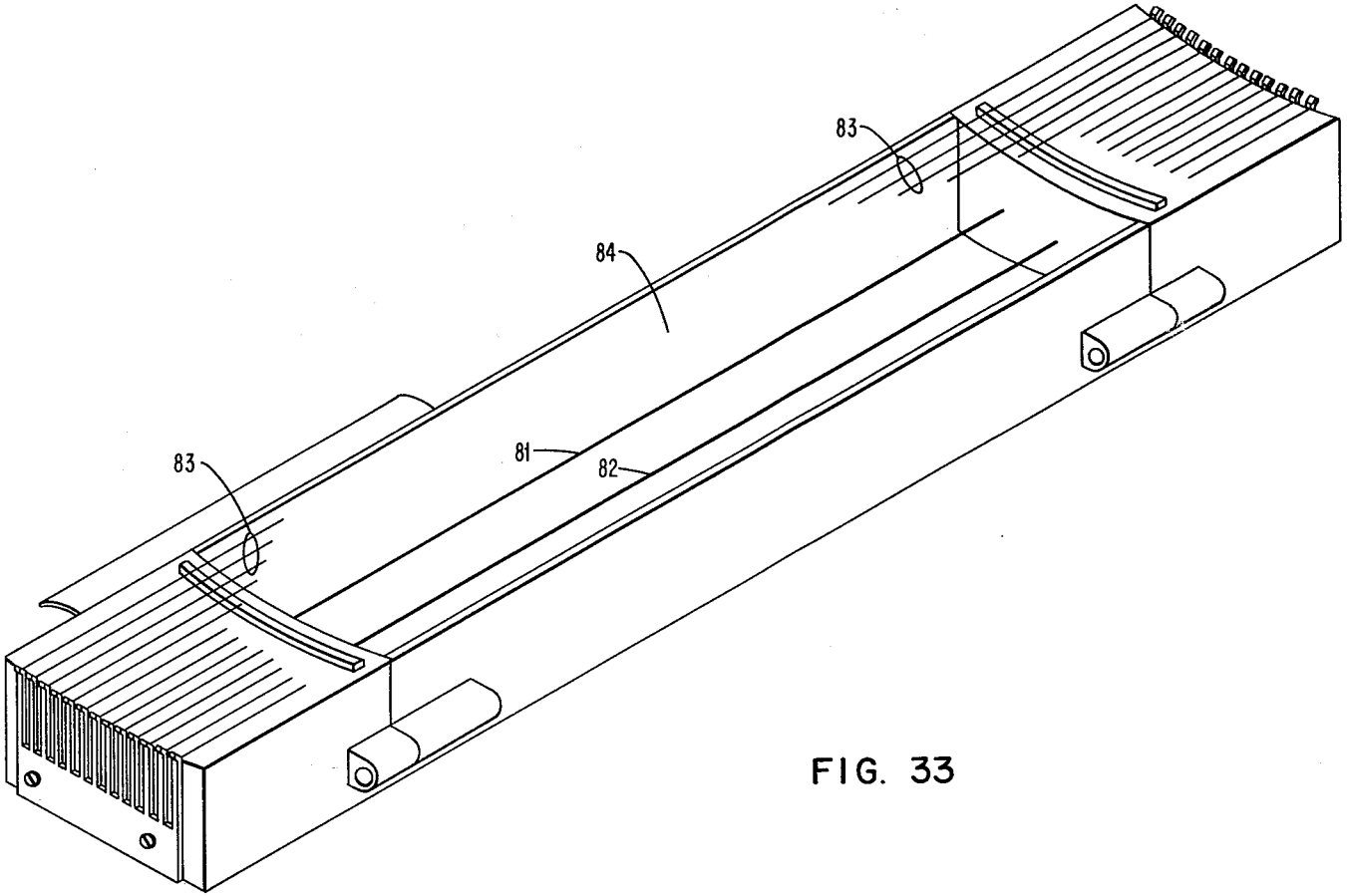
FIG. 33 shows the configuration of a backcharge corona.

FIG. 33 shows a backcharge corona construction such as may be used at 22 in FIG. 1, 45 in FIG. 2, or 450 in FIG. 3. Emission wires 81 and 82 are connected to a high voltage power supply and produce the ions opposite in polarity to those produced at the charging station. Grid wires are connected to a low voltage source and extend across the corona opening 84, although the wires 83 are broken in FIG. 33 for clarity. The grid 83 controls the amount of ions reaching photoreceptive surface 38 and insures a uniform charge thereon. Essentially, there is no configurational difference between the backcharge corona shown in FIG. 31 and the usual gridded charge corona. FIG. 1 shows that the grids on the charge and backcharge coronas may be connected to a common power supply, if desired.

While the invention has been particularly shown and described with reference to a preferred embodiment thereof, it will be understood by those skilled in the art that different photoconductor materials will create different needs. For example, most selenium photoconductor systems utilize toner with a native negative triboelectric charge and carrier with a native positive triboelectric charge. The charge and transfer coronas in such a system are positive and the preclean corona is negative. This invention, practiced in such a system, would call for the addition of a negative backcharge corona. Those skilled in the art will appreciate that this invention can also be practiced with monocomponent solid development material and with liquid developers. Moreover, various corona construction techniques can be used, for example, a grid can be placed across only half the corona opening, if desired, or coronas could be arranged in bays of a single large device. The foregoing and many other changes in form and details may be made without departing from the spirit and scope of the invention.

What is claimed is:

1. In a one-cycle electrophotographic process of the transfer type, a method of cleaning residual toner particles from background areas of an image on a photoreceptive surface during production of multiple copies of the same subject while simultaneously developing the character areas of the image of said subject comprising the steps of:

charging said surface to a first level;

reducing said charge to a second level; and applying developer material to said photoreceptive surface to develop the character areas of said image while removing residual toner from the background areas of said image.

2. The method of claim 1 wherein said residual toner is electrically attracted away from said background areas by the application of a developer voltage near the photoreceptive surface.

3. The method of claim 1 wherein said developer material is magnetically attracted away from said photoreceptive surface.

4. The method of claim 3 wherein said residual toner is electrically attracted away from said background areas by the application of a developer voltage near the photoreceptive surface.

5. The method of claim 1 wherein said developer material is a two component mixture comprising toner with a triboelectric charge of a first polarity and carrier with a triboelectric charge of a second polarity, and where said residual toner is electrostatically attracted to said carrier.

6. The method of claim 5 wherein said residual toner is electrically attracted away from said background areas by the application of a developer voltage of said second polarity near the photoreceptive surface.

7. The method of claim 6 wherein said developer material is magnetically attracted away from said photoreceptive surface.

8. The method of claim 1 wherein the process includes re-imaging said subject on said photoreceptive surface between said charge reducing step and said applying developer step.

9. The method of claim 8 wherein said residual toner is electrically attracted away from said background areas by the application of a developer voltage near the photoreceptive surface.

10. The method of claim 9 wherein said developer material is magnetically attracted away from said photoreceptive surface.

11. The method of claim 8 wherein said developer material is a two component mixture comprising toner with a triboelectric charge of a first polarity and carrier with a triboelectric charge of a second polarity, and where said residual toner is electrostatically attracted to said carrier.

12. The method of claim 11 wherein said residual toner is electrically attracted away from said background areas by the application of a developer voltage of said second polarity near the photoreceptive surface.

13. The method of claim 12 wherein said developer material is magnetically attracted away from said photoreceptive surface.

14. A method of cleaning residual toner particles from the photoreceptive surface of a one-cycle electrophotographic copier machine of the transfer type without using a cleaning station separate from the developing station comprising the steps of:

transferring toner particles having a natural first triboelectric polarity from a developed image on said photoreceptive surface to image receiving material, said transferring of toner leaving residual untransferred toner particles on said surface;

subsequently bombarding said surface with ions of a second polarity;

then bombarding said surface with ions of the first polarity to reduce the charge on said surface to a desired level and to insure that the particles of untransferred toner have their natural triboelectric polarity; and applying developer material at a developing/cleaning station to said photoreceptive surface to act upon at least a portion of said residual particles and remove them from said surface.

15. The method of claim 14 wherein said developer material is magnetically attracted away from said photoreceptive surface.

16. The method of claim 14 wherein the removed residual particles are primarily in the background, that is, untoned area of the image.

17. The method of claim 16 wherein said residual toner is electrically attracted away from said background areas by the application of a developer voltage of a second polarity near the photoreceptive surface.

18. The method of claim 17 wherein said developer material is magnetically attracted away from said photoreceptive surface.

19. The method of claim 18 wherein residual toner not removed from the photoreceptive surface at the developing/cleaning station is primarily in the toned area of the image.

20. The method of claim 19 wherein a successive image on said photoreceptor is developed simultaneously with the cleaning of residual toner from the preceding image.

21. The method of claim 14 wherein said developer material is a two component mixture comprising toner with a triboelectric charge of said first polarity and carrier with a triboelectric charge of said second polarity, and where said residual toner is electrostatically attracted to said carrier.

22. The method of claim 21 wherein the removed residual particles are primarily in the background, that is, untoned area of the image.

23. The method of claim 22 wherein said residual toner is electrically attracted away from said background areas by the application of a developer voltage of a second polarity near the photoreceptive surface.

24. The method of claim 23 wherein said developer material is magnetically attracted away from said photoreceptive surface.

25. The method of claim 24 wherein a successive image on said photoreceptor is developed simultaneously with the cleaning of residual toner from the preceding image.

26. An electrophotographic copy process wherein a subject to be copied is imaged onto a photoreceptive surface, the copy process cycle comprising the steps of:

(1) charging the photoreceptive surface to a level higher than desired by bombarding the surface with ions of a first polarity;
(2) reducing the charge level on the photoreceptive surface to a desired level by bombarding the photoreceptive material with ions of a second polarity;
(3) exposing the photoreceptive material to a light image of said subject;
(4) developing said subject while simultaneously cleaning said photoreceptive surface of developing material remaining on said photoreceptive surface from a previous copy process cycle;
(5) transferring the developed image to a sheet of receiving material to produce a copy; and
(6) repeating steps 1–5 of said cycle to produce a subsequent copy without utilizing a separate cleaning cycle.

27. The process of claim 25 wherein the charging step is performed by a first corona generator connected to a power supply of a first polarity, and wherein said reducing step is performed by a second corona generator connected to a power supply of a second polarity.

28. The process of claim 26 wherein said first and second corona generators are gridded.

29. The process of claim 28 wherein the grid of said first corona is connected to a power supply of said first polarity.

30. The process of claim 29 wherein the grid of said second corona is connected to a power supply of said first polarity.

31. The process of claim 30 wherein the grid of said first corona and the grid of said second corona are connected to a common power supply and receive an equal voltage level.

32. The process of claim 25 further including a preclean step after the transfer step and prior to the charging step to neutralize the charge on the photoreceptive surface to a level of approximately zero by bombarding the surface with ions opposite in polarity to those received during step 1.

33. The process of claim 32 wherein the charging step is performed by a first corona generator connected to a power supply of a first polarity, and wherein said reducing step is performed by a second corona generator connected to a power supply of a second polarity.

34. The process of claim 33 wherein said first and second corona generators are gridded.

35. The process of claim 34 wherein the grid of said first corona is connected to a power supply of said first polarity.

36. The process of claim 35 wherein the grid of said second corona is connected to a power supply of said first polarity.

37. The process of claim 36 wherein the grid of said first corona and the grid of said second corona are connected to a common power supply and receive an equal voltage level.

38. In a one cycle electrophotographic copy process of the transfer type in which a separate cleaning station is not used and in which apparatus is used to develop and clean simultaneously, comprising the steps of charging a photoreceptive surface with ions of a first polarity, exposing said surface to light rays representing the subject to be copied to form an image thereof on said surface, developing said image, and transferring said image to image receiving material, the improvement comprising the step of:

after charging said surface but prior to exposure, backcharging said photoreceptive surface with ions of a second polarity to reduce the charge on said photoreceptive surface to a desired level.

39. The one cycle process of claim 38 wherein the charging step is performed by a first corona generator connected to a power supply of a first polarity, and wherein the backcharging step is performed by a second corona generator connected to a power supply of a second polarity.

40. The one cycle process of claim 39 wherein said first and second corona generators are gridded.

41. The one cycle process of claim 40 wherein the grid of said first corona is connected to a power supply of said first polarity.

42. The one cycle process of claim 41 wherein the grid of said second corona is connected to a power supply of said first polarity.

43. The one cycle process of claim 41 further including a preclean step after transfer and prior to the charging step to neutralize the charge on the photoreceptive surface to a level of approximately zero by bombarding the surface with ions of said second polarity.

44. The one cycle process of claim 42 further including a preclean step after transfer and prior to the charging step to neutralize the charge on the photoreceptive surface to a level of approximately zero by bombarding the surface with ions of said second polarity.

* * * * *